United States Patent [19]

Hasselbach et al.

[11] 4,138,593

[45] Feb. 6, 1979

[54] MOVING VOICE COIL LOUDSPEAKER WITH HEAT DISSIPATING ENCLOSURE

[75] Inventors: Wolfgang Hasselbach, Königstein; Manfred Leyerzapf, Frankfurt am Main; Klaus Dotter, Frankfurt-Bonames; Karleugen Habfast, Schwalbach; Karl Müller, Frankfurt am Main-Nied, all of Fed. Rep. of Germany

[73] Assignee: Braun AG, Frankfurt am Main, Fed. Rep. of Germany

[21] Appl. No.: 771,798

[22] Filed: Mar. 2, 1977

[51] Int. Cl.[2] ..... H04R 1/02

[52] U.S. Cl. ..... 179/1 E

[58] Field of Search ..... 179/1 E

[56] References Cited

U.S. PATENT DOCUMENTS

| | | | |
|---|---|---|---|
| 2,217,177 | 10/1940 | Massa | 179/115.5 R |
| 3,991,286 | 11/1976 | Henricksen | 179/115.5 H |
| 4,029,910 | 6/1977 | Allison | 179/115.5 ME |

FOREIGN PATENT DOCUMENTS

| | | | |
|---|---|---|---|
| 732959 | 2/1943 | Fed. Rep. of Germany | 179/115.5 R |

*Primary Examiner*—George G. Stellar

*Attorney, Agent, or Firm*—Michael J. Striker

[57] ABSTRACT

The dynamic loudspeaker is comprised of a speaker housing and a front sound panel. A diaphragm is mounted at the front of the speaker. A moving-coil unit is mounted in the speaker and includes a moving coil coupled to the diaphragm for transmitting oscillatory motion thereto. The moving-coil unit when in operation generates heat to such an extent as to tend to limit the rated steady power at which the loudspeaker can be operated without damage to the moving-coil unit. This limiting tendency is counteracted according to the invention by improving the dissipation of the heat generated by the moving-coil unit. The speaker housing or a surface portion thereof and/or the speaker sound panel or sound wall or a surface portion thereof is comprised of a material having a thermal conductivity W equal to or greater than 40 kcal/m-h-° C. A heat-transmitting structure is comprised of a material likewise having a thermal conductivity W equal to or greater than 40 kcal/m-h-° C. and it extends from the moving-coil unit to at least one of the aforementioned portions of the housing and/or sound wall, and is in thermally conductive engagement with both the latter and the moving-coil unit.

3 Claims, 5 Drawing Figures

MOVING VOICE COIL LOUDSPEAKER WITH HEAT DISSIPATING ENCLOSURE

BACKGROUND OF THE INVENTION

The invention relates to dynamic loudspeakers and in particular to the problem of increasing the rated steady power at which they can be driven.

The performance of loudspeakers can be numerically described by a variety of measurable characteristics. Besides magnetic characteristics, the ones most often considered are the peak power at which the speaker can be driven, the natural resonant frequency of the speaker, the frequency range of the speaker, the operating power of the speaker, the sensitivity of the speaker, the frequency-dependence of the gain and phase of the speaker, and the nominal steady power at which the speaker can be driven. The latter signifies the input power at which the speaker can be steadily driven without undergoing permanent damage.

With dynamic loudspeakers, the nominal steady power at which the speaker can be driven is limited by a number of factors, including the heat generated by the moving-coil unit of the speaker during operation. For this reason, high-powered moving-coil units are often comprised of moving coils wound on aluminum coil carriers and fabricated using highly-temperature resistant cement or glue. The moving coil principally transmit the heat which it generates to the central pole core and outer pole plates of the permanent magnet structure of the moving-coil unit, resulting in a heating-up of the entire magnet system. Contributing to this heat build-up is the fact that the magnet system of the moving-coil unit, for acoustical reasons, is often surrounded with mineral wool having heat-insulating characteristics. In some speakers, use is made of spider structures made of aluminum, a material of high thermal conductivity. However, the aluminum spider structures do not establish a heat-dissipating action. Typically, they are comprised of narrow radial arms leading to the front side of the speaker housing, with little or no transmission of heat from these spider arms to the housing. Most often, the ends of the spider arms are mounted on the spider housing by means of resilient material of extremely low thermal conductivity.

SUMMARY OF THE INVENTION

It is a general object of the invention to increase the nominal steady power at which such a speaker can be driven, by dissipating in a novel and highly effective manner the heat generated by the moving-coil unit of the speaker.

According to one advantageous concept of the invention, this is achieved by making the speaker housing, or a part thereof, or one or more parts of the surface thereof, and/or the speaker sound panel or sound wall, or a part thereof, or one or more parts of the surface thereof, of a material having a thermal conductivity W equal to or greater than 40 kcal/m-h-° C. There is then provided a heat-transmitting structure which is comprised of a material likewise having a thermal conductivity W equal to or greater than 40 kcal/m-h-° C. The heat-transmitting structure extends from the moving coil unit to one or more of the aforementioned high-thermal-conductivity parts of the speaker housing or sound wall, and is in thermally conductive engagement with both the moving coil unit and such one or more high-thermal-conductivity parts.

The improved dissipation of the heat generated by the moving-coil unit of the speaker increases considerably the steady power at which the speaker can be driven without undergoing permanent damage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
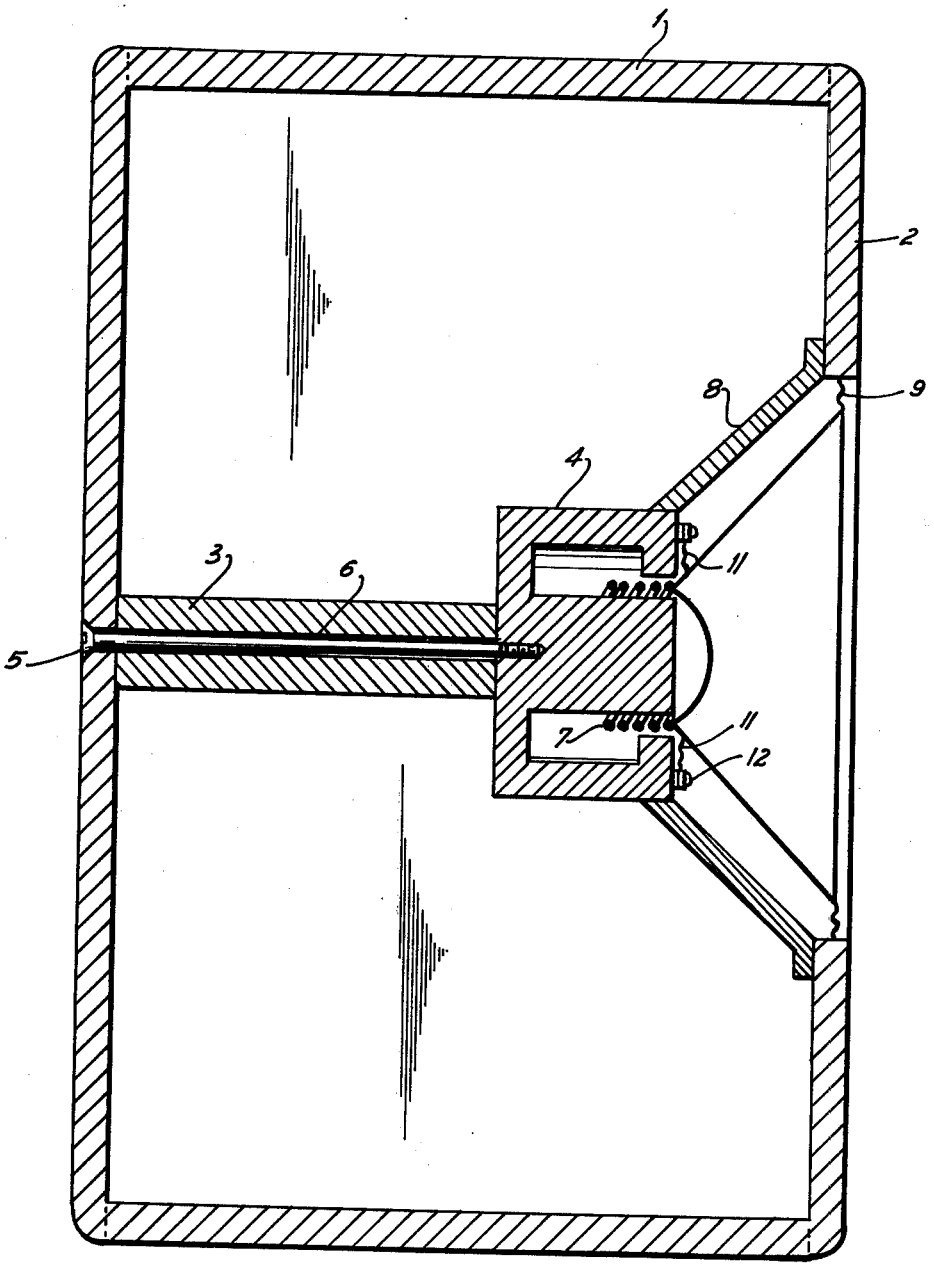
FIGS. 1–5 depict five different embodiments of the present invention.

In FIG. 1, numeral 1 denotes the loudspeaker housing, here made of a material having a thermal conductivity W equal to or greater than 40 kcal/m-h-° C., where kcal = kilocalories, m = meters, h = hours, and ° C. = degree celsius. One example of such a material is aluminum. The speaker is provided on its front side with a sound panel 2, which can be considered part of the speaker housing or a separate part, and which may or may not be integral therewith. In FIG. 1, the sound wall has the form of such a flat sound panel 2, but other configurations and shapes could likewise be utilized. An aluminum bar 3 has its left end in thermally conductive engagement with the back wall of the speaker housing 1, and has its right end in thermally conductive engagement with the rear face of the permanent magnet structure 4 of the moving-coil unit of the speaker. The aluminum bar 3 is connected to the back wall of the housing and to the permanent magnet structure by means of a long screw 5 which passes through the back wall of the housing, through an interior bore 6 in the bar 3 and has a threaded end screwed into a threaded bore in the permanent magnet structure 4.

Mounted on the permanent magnet structure 4 is the moving coil 7 of the moving-coil unit. Coil 7 is wound on an aluminum coil carrier structure and is fabricated using a cement of high temperature resistance and of high thermal conductivity, so that the heat generated within coil 7 will be readily transmitted to the permanent magnet structure 4. A spider structure 8 has its outer ends connected to the sound panel 2, to which is also connected the edge suspension 9 for the speaker diaphragm 10. The speaker additionally includes a centering or positioning diaphragm 11 which is connected with the permanent magnet structure 4 by means of screws 12.

During operation of the moving coil 7, the heat which it generates is mainly transmitted to the central core portions of the permanent magnet structure 4. This results in a heating-up of the entire magnet system. The aluminum bar 3, because its thermal conductivity W is likewise equal to or greater than 40 kcal/m-h-° C., transmits this generated heat very efficiently to the aluminum rear wall of the speaker housing 1, where it is readily dissipated into the ambient air.

Figure 2:
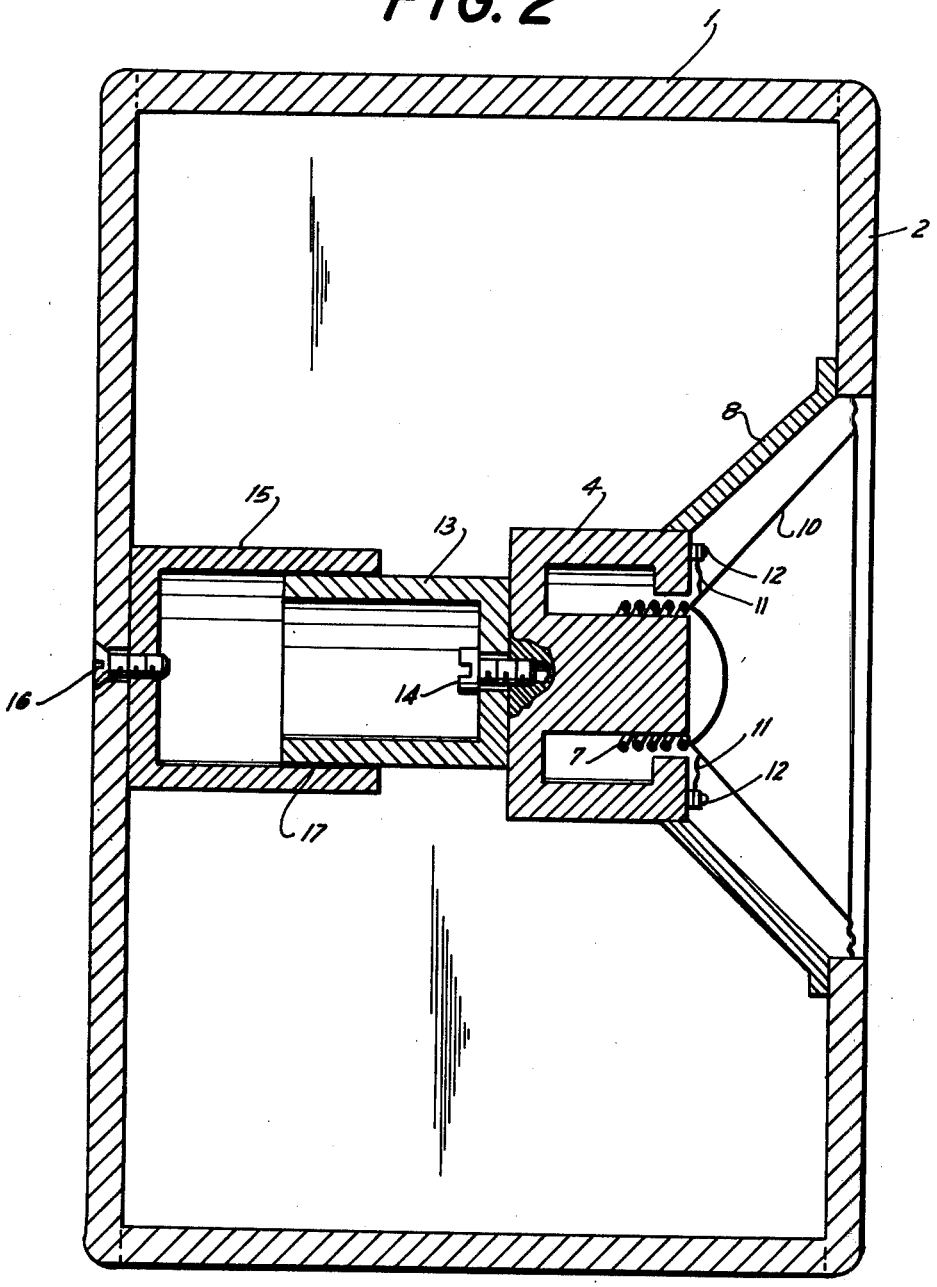

In the embodiment of FIG. 2, the one-piece heat-transmitting structure of FIG. 1 is replaced by a two-piece heat-transmitting structure 13, 15 which permits back-and-forth movement of the permanent magnet structure 4. The heat-transmitting structure 13, 15 is comprised of a first component 13 which is connected to the permanent magnet structure 4 by means of a screw 14 and is in thermally conductive engagement with the permanent magnet structure 4. The heat-transmitting structure 13, 15 includes a second component 15 which is connected to the back wall of the aluminum housing of the speaker by means of a screw 16 and is in thermally conductive engagement with the aluminum back wall. The first and second components 13, 15 have the form of cylindrical pipes, of which pipe 13 is slidably received within and guided by pipe 15, the outer diameter of pipe 13 being just slightly smaller than the inner diameter of pipe 15. This makes it possible for the component 13, fixedly secured to the permanent magnet structure 4, to respond to back-and-forth movement of the latter by sliding back and forth within the component 15. To ensure that the thermally conductive engagement between first and second components 13 and 15 is sufficiently good, it is advantageous to provide a paste 17 of high thermal conductivity between the two components.

Figure 3:
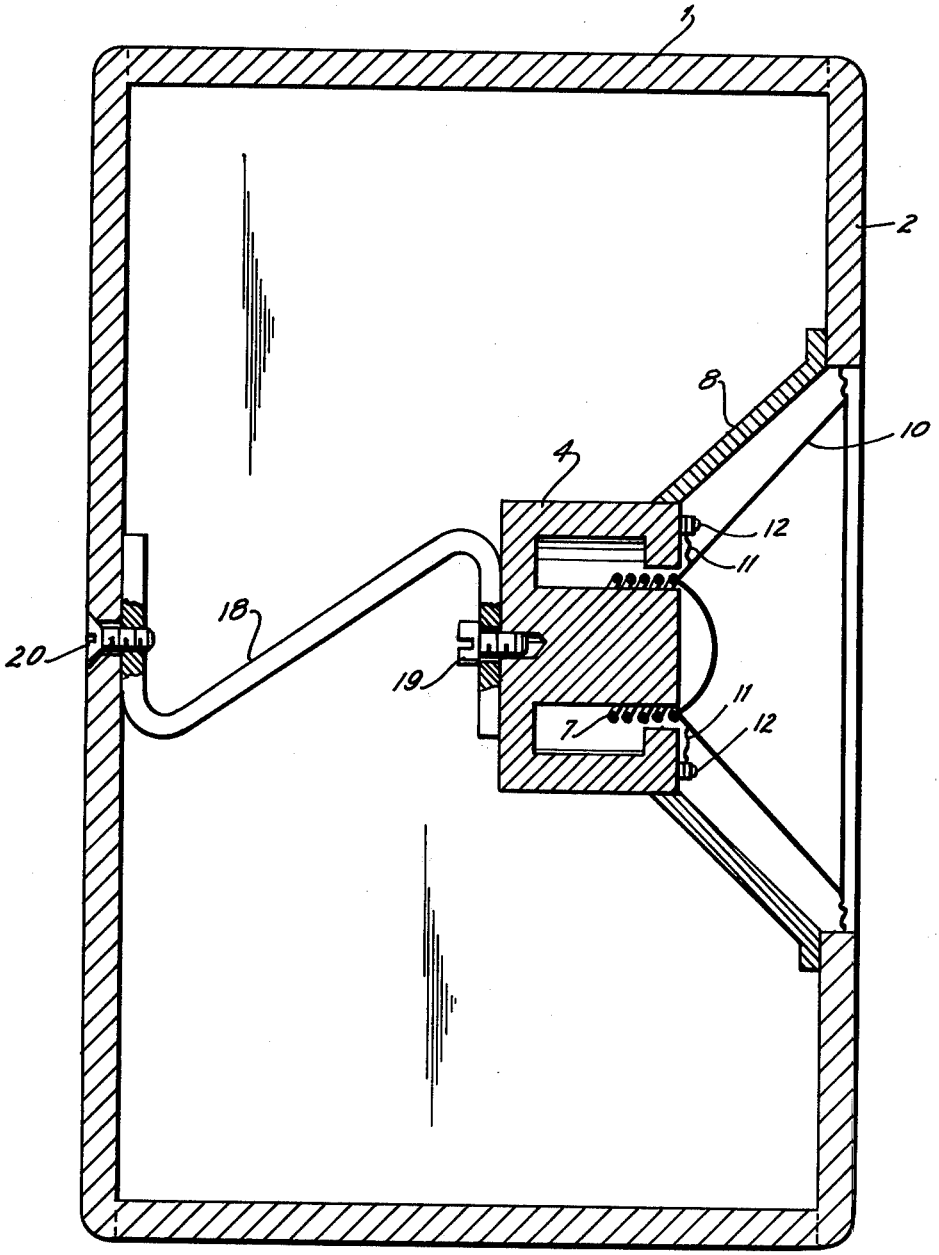

FIG. 3 depicts a modification of the embodiment of FIG. 2, requiring no thermally conductive paste 17, and of inherently simpler construction, and also somewhat easier to assemble. In FIG. 3, the heat-transmitting structure is comprised of a sheet-metal strip 18, bent to have an S-shape. Its right end is secured to the permanent magnet structure 4 by means of a screw 19 and is in thermally conductive engagement with the permanent magnet structure 4. Its left end is secured to the aluminum back wall of the speaker housing by means of a screw 20 and is in thermally conductive engagement with the aluminum back wall. The embodiment of FIG. 3, compared to that of FIG. 2, does not create manufacturing tolerance problems. It is possible to use resilient heat-transmitting bodies, embodying the concept of FIG. 3, but of different configuration, i.e., not sheet-metal strips.

Figure 4:
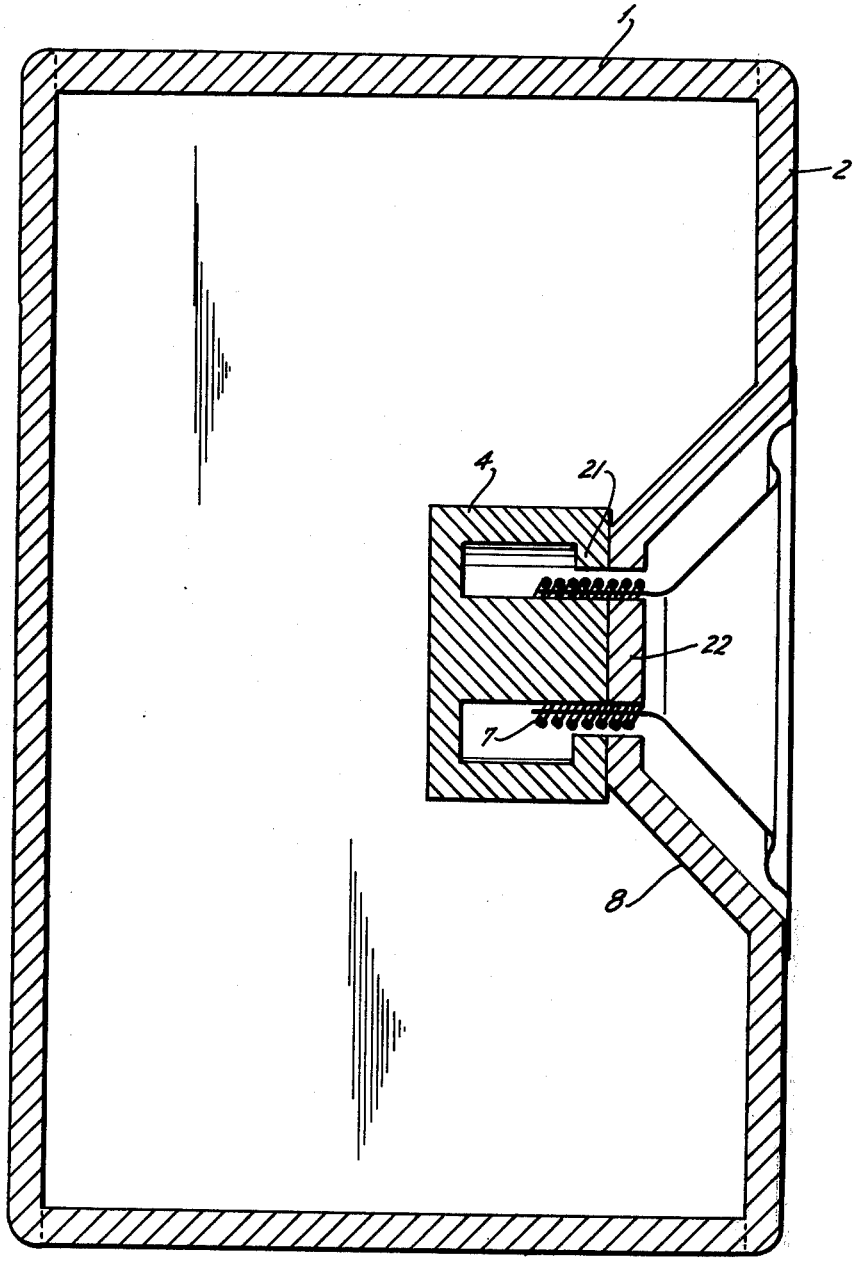

FIG. 4 depicts an embodiment in which the second panel 2 is made of aluminum and the heat generated by the moving-coil unit is transmitted to the sound panel for dissipation into the ambient air. In this embodiment, the spider structure 8 of the speaker is of one piece with the sound panel 2, and accordingly transmits thereto, quite directly, the heat being generated in moving coil 7, to some extent also through the intermediary of the outer pole plate part 21 of the permanent magnet structure. The integration of the second panel 2 and the spider structure 8 has the additional advantage that the total number of speaker parts is reduced.

For reasons well known in the art, the axial length of the moving coil 7 exceeds the thickness of the pole plate section 21 of the permanent magnet structure 4. The inner end of the spider structure 8 is provided with an opening whose diameter corresponds to that of the annular gap in the permanent magnet structure in which the moving coil 7 is mounted. Here the diameter of the opening in the center of the spider structure 8 is equal to the outer diameter of the annular gap in the permanent magnet structure 4, and is carefully assembled to be in exact register therewith. The central core portion of the permanent magnet structure 4 is provided with an extension 22 having a thickness equal to that of the inner part of the spider structure 8. The inner part of the spider structure 8 has a thickness comparable to that of the pole plate section 21 and forms a structural continuation of section 21. The heat generated by the moving coil 7 is transmitted to the pole plate section 21, to the extension 22, and in that way to the spider structure 8, and from there to the aluminum sound panel 2.

Figure 5:
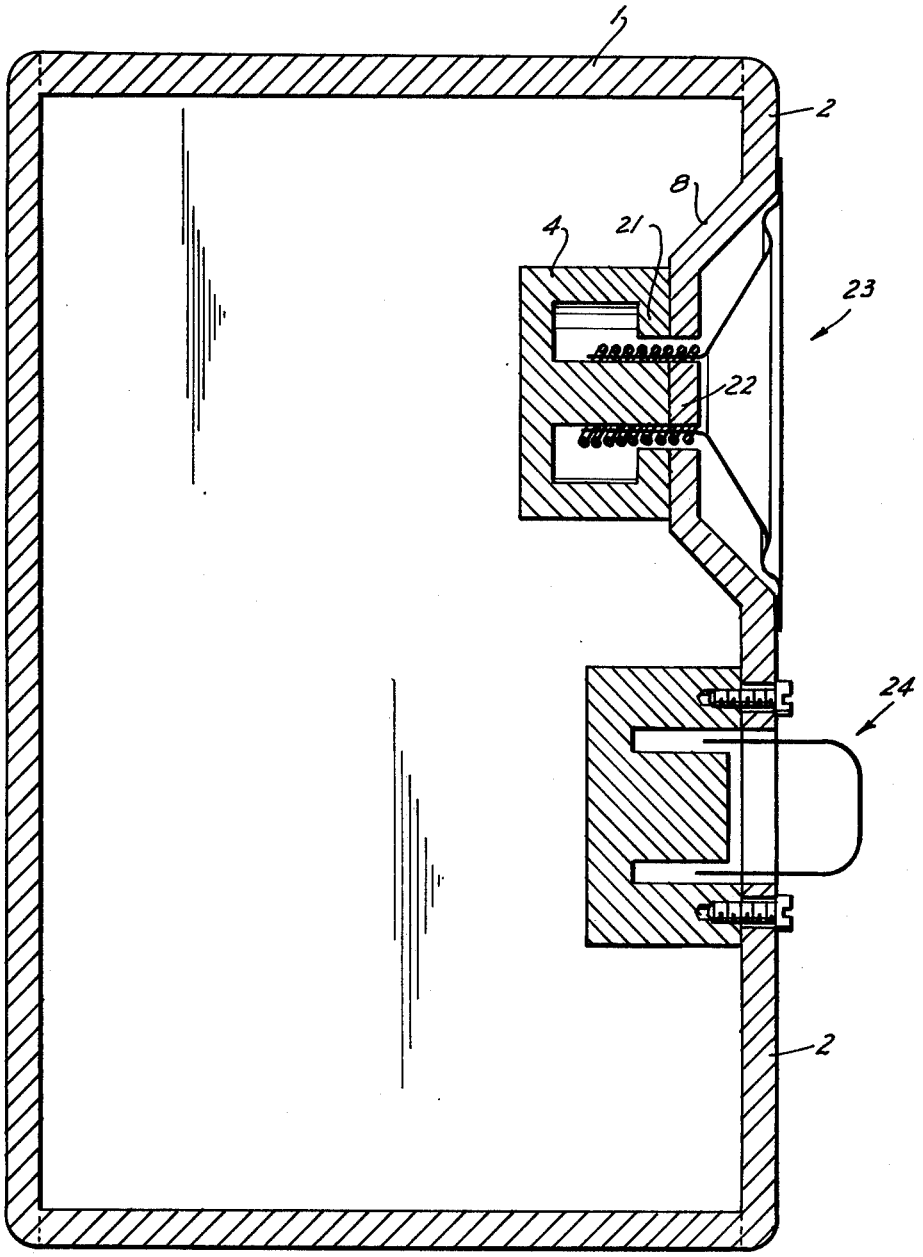

FIG. 5 depicts a modification of the embodiment shown in FIG. 4. Here, in addition to the low-frequency-range speaker unit 23, the sound wall 22 of the speaker is large enough to also mount a middle- or high-frequency-range speaker unit 24. Accordingly, both speaker units are located in a single radiation plane. Advantageously, the housing 1 and the front wall panel 2 are cast as a one-piece casting.

In general, with respect to the embodiments of FIGS. 1–5, the following should be noted. The housing 1 can be made of a material of the high thermal conductivity in question (e.g., aluminum) in its entirety. Alternatively, it can be comprised of a portion made of such material, or of a plurality of such portions. The highly thermally conductive portion could be provided on the external surface of the housing 1, and a plurality of such surface portions could be provided. The heat-transmitting structure could then extend to each of the plurality of heat-dissipating portions. This likewise applies to the sound panel 2. All of sound panel 2, or just a part thereof, or a plurality of discrete parts thereof, or one or more surface portions thereof, can be made of the highly thermally conductive material. Advantageously, the sound panel 2 is of one piece with the spider structure and/or with the housing, in all embodiments. Also, whereas in FIGS. 1–5 a speaker of rectangular geometry, having a planar sound panel 2 at its front is shown, the invention is equally applicable to speakers of non-rectangular geometry, having non-planar sound walls 2. In general, the inventive concept is applicable to dynamic speakers of any design, wherever the problem of heat dissipation is encountered. The heat generated by the moving coil of the moving-coil unit can be transmitted to the ambient air via a heat-transmitting structure provided in addition to the anyway present structural parts of the speaker, or the anyway present parts of the speaker can be made of such materials and designed for thermally conductive engagement with one another, to effect the desired heat transmission and dissipation without the addition of a distinct heat-transmitting structure.

It will be understood that each of the elements described above, or two or more together, may also find a useful application in other types of constructions differing from the types described above.

While the invention has been illustrated and described as embodied in speakers of particular design, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a dynamic loudspeaker of the type comprised of a housing part and a sound wall part, a diaphragm mounted in the speaker, a moving-coil unit mounted in the speaker and including a moving coil coupled to said diaphragm for transmitting oscillatory motion thereto, said moving-coil unit when in operation generating heat to such an extent as to tend to limit the rated steady power at which the loudspeaker can be operated without damage to said moving-coil unit, the improvement wherein at least one of said parts is comprised of at least one portion made of a material having a thermal conductivity W equal to or greater than 40 kcal/m-h-° C., and further including a heat-transmitting structure comprised of a material likewise having a thermal conductivity W equal to or greater than 40 kcal/m-h-° C., said heat-transmitting structure extending from said moving-coil unit to said at least one portion and being in thermally conductive engagement with both said moving-coil unit and said at least one portion, said housing part including said at least one portion, said moving-coil unit including a permanent magnet structure, said moving coil of said unit being mounted on said permanent magnet structure, said heat-transmitting structure comprising a bent S-shaped sheet-metal strip comprised of said material and having two ends, one of said ends being connected to said permanent magnet structure in thermally conductive engagement therewith, the other of said ends being connected to said at least one portion of said housing part in thermally conductive engagement therewith.

2. In a dynamic loudspeaker of the type comprised of a housing part and a sound wall part, a diaphragm mounted in the speaker, a moving-coil unit mounted in the speaker and including a moving coil coupled to said diaphragm for transmitting oscillatory motion thereto, said moving-coil unit when in operation generating heat to such an extent as to tend to limit the rated steady power at which the loudspeaker can be operated without damage to said moving-coil unit, the improvement wherein at least one of said parts is comprised of at least one portion made of a material having a thermal conductivity W equal to or greater than 40 kcal/m-h-° C., and further including a heat-transmitting structure comprised of a material likewise having a thermal conductivity W equal to or greater than 40 kcal/m-h-° C., said heat-transmitting structure extending from said moving-coil unit to said at least one portion and being in thermally conductive engagement with both said moving-coil unit and said at least one portion, said moving-coil unit including a permanent magnet structure, said moving coil of said unit being mounted on said permanent magnet structure, said heat-transmitting structure comprising first and second components each comprised of said material, said first component being connected to said permanent magnet structure in thermally conductive engagement therewith, said second component being connected to said at least one portion in thermally conductive engagement therewith, one of said components being received within the other of said components, said first component being guided by said second component for movement relative to said first component in a predetermined direction so as to permit limited movement of said permanent magnet structure, said first and second components being in thermally conductive engagement with each other.

3. In a dynamic loudspeaker as defined in claim 2, said heat-transmitting structure further including thermally conductive paste located intermediate said first and second components and establishing said thermally conductive engagement between said first and second components.

* * * * *